US007999694B2

(12) United States Patent
Martin et al.

(10) Patent No.: US 7,999,694 B2
(45) Date of Patent: Aug. 16, 2011

(54) SENSOR MODULE

(76) Inventors: Arthur L. Martin, Millbury, MA (US); Mark Simonds, Agawam, MA (US); Mark Weber, Clearwater, FL (US)

( * ) Notice: Subject to any disclaimer, the term of this patent is extended or adjusted under 35 U.S.C. 154(b) by 408 days.

(21) Appl. No.: 12/370,016

(22) Filed: Feb. 12, 2009

(65) Prior Publication Data

US 2010/0201537 A1 Aug. 12, 2010

(51) Int. Cl.

| | |
|---|---|
| ***G08B 5/00*** | (2006.01) |
| ***A63B 69/00*** | (2006.01) |
| ***B41L 1/00*** | (2006.01) |

(52) U.S. Cl. ..... 340/815.4; 340/555; 340/686.6; 340/323 R; 463/2; 463/5; 463/49; 463/52; 473/150; 473/154; 473/190; 473/196; 473/198; 473/422; 473/478; 473/446

(58) Field of Classification Search ..... 340/815.4; 463/2; 473/478

See application file for complete search history.

(56) References Cited

U.S. PATENT DOCUMENTS 7,850,514 B2 * 12/2010 Weber ..... 463/2

* cited by examiner

*Primary Examiner* — Donnie Crosland

(74) *Attorney, Agent, or Firm* — Maxey Law Offices, PLLC; Stephen Lewellyn

(57) ABSTRACT

An electronic sensor module for us in an interactive system, such as an interactive sports training device, for accurately detecting a projectile brought within close proximity of a target. The sensor module includes a plurality of light sources arranged in a housing such that the light sources are visible through a surface of the housing when activated. A plurality of sensors are also arranged in the housing for detecting the presence of a projectile. In one aspect, the sensors are arranged in a polar array about a center of housing with spaces between adjacent sensors, and with a light source positioned in each space between adjacent sensors.

9 Claims, 7 Drawing Sheets

SENSOR MODULE

FILED OF THE INVENTION

The present invention relates generally to sensing a projectile in an interactive system, and more particularly, relating to a sensor module for use in connection with an interactive sports training device for accurately detecting the location of a non-stationary projectile.

BACKGROUND OF THE INVENTION

There exists numerous configurations of sensor and sensor systems used in myriad of interactive games and interactive training devices. While the existing sensor configurations and sensor systems work well for their respective and intended purposes, they are less desirable for use in an interactive sports training system where a projectile is continuously moved between target locations without becoming stationary, and where the interactive system must quickly determine if the projectile was correctly moved to a target location. Further, existing sensor configurations and sensor systems are based upon static targets, they are integrated into the interactive training device and cannot be easily replaced or relocated, and do not provide a dynamic visual indicator at each sensor to indicate a target position. Accordingly, there is a need for an improved sensor module for use in an interactive sports training device that overcomes the drawbacks of the existing sensor configurations and sensor systems. More particularly, there is a need for a sensor module for use in an interactive sports training device for training hockey players and other athletes engaged in sports involving a ball or the like, requiring accurate maneuvering, positioning, passing and shooting of the ball, or the like, including for example, hockey, tennis, and soccer. Further, there is a need for a sensor module that can be easily inserted and removed from a playing surface of an interactive sports training device.

SUMMARY OF THE INVENTION

It is, therefore, an aspect of the preferred embodiments of the present invention to provide a sensor module for use in an interactive training device, for example an interactive hockey training device that is capable of accurately detecting a moving projectile positioned at a target location.

It is another aspect of the preferred embodiments of the present invention to a senor module that integral and is readily connectable to a logical controller/computer processor of an interactive training device.

It is another aspect of the preferred embodiments of the present invention to provide a sensor module that can be received within a recess of a playing surface of an interactive training device.

It is another aspect of the preferred embodiments of the present invention to provide a sensor module including a dynamical visual indicator that is operable to indicate a target position.

It is another aspect of the preferred embodiments of the present invention to provide a sensor module that can be used with multiple alike sensor modules in an interactive training device.

To achieve these and other advantages, in general, in one embodiment, a sensor module for use in connection with an interactive training device including a programmable logic controller and a projectile having at least one emitter is provided. The sensor module includes a housing with a surface; a plurality of sensors arranged within the housing, each of the plurality of sensors being electrically connected together forming a sensor unit; a plurality of light sources arranged within the housing, each light source of the plurality of light sources being visible at the surface when activated, wherein the sensor unit is associated with the plurality of light sources and is triggered when a projectile of an interactive training device is brought into close proximity with an activated light source of the plurality of light sources; a microprocessor coupled to each of the plurality of light sources and the sensor unit, the microprocessor being connectable to a processor of an interactive training device for bidirectional communication therewith; and wherein the microprocessor is programmed to activate at least one of the plurality of light sources upon receiving a light on command signal from the processor, to deactivate the at least one activated light source when the sensor unit is triggered, and to transmit a light status signal to the processor of the interactive training device.

In one embodiment, the plurality of sensors are arranged within the housing in a polar array about a center point with a space between adjacent sensors, and wherein the plurality of light sources are arranged within the housing with at least one light source located in each space between adjacent sensors.

In one embodiment, the plurality of sensors are arranged within the housing in an rectangular array with a space between adjacent sensors, and wherein the plurality of light sources are arranged within the housing with at least one light source located in each space between adjacent sensors.

In one embodiment, the housing is adapted to be received by a playing surface of the interactive training device.

In one embodiment, the surface of the housing is a playing surface in an interactive training device.

In one embodiment, each of the sensors is a magnetic field sensor.

In one embodiment, the magnetic field sensor is a magnetic reed switch.

In one embodiment, each of the plurality of sensors are electrically connected together in parallel forming the sensor unit.

In one embodiment, the plurality of sensors are arranged within the housing in a closed array defining an interior space bound by the plurality of sensors, and wherein the plurality of light sources are located within the interior space.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
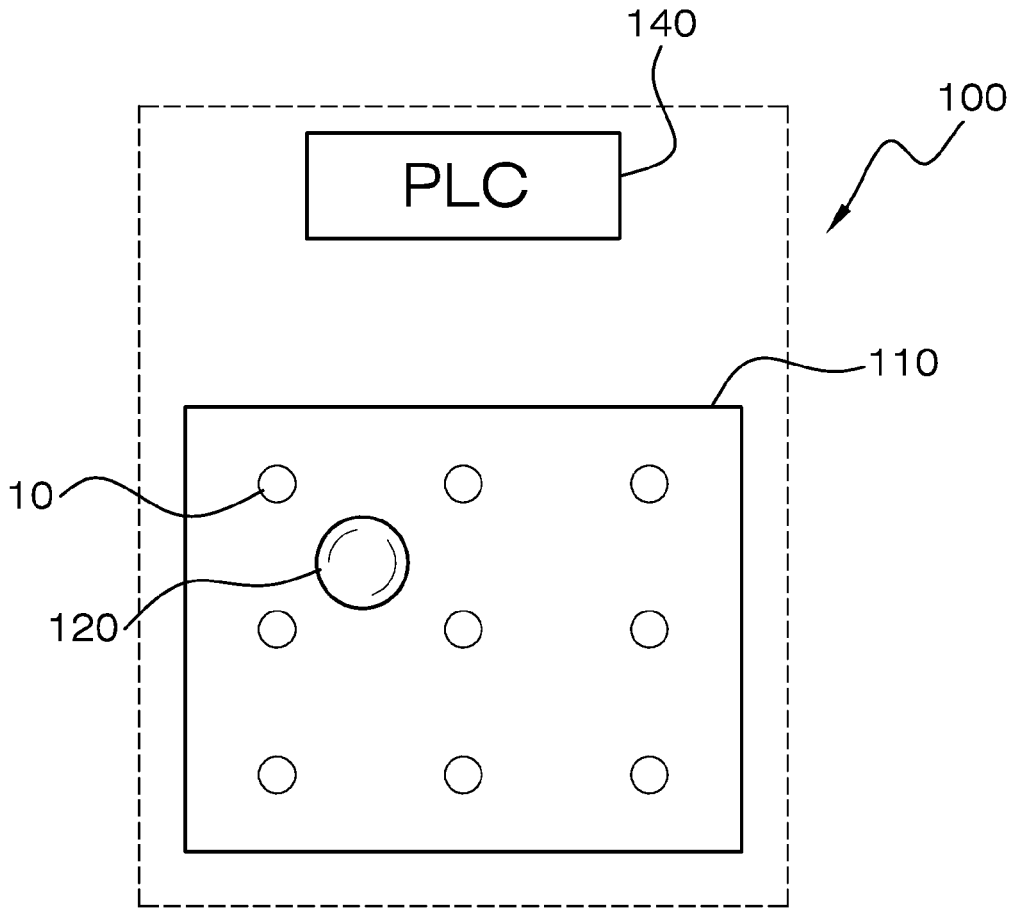
FIG. 1 is a diagrammatic view of an interactive sports training device including the sensor module constructed in accordance with the principles of the present invention.

Reference will now be made in detail to the preferred embodiments of the present invention, examples of which are illustrated in the accompanying drawings. Referring initial to FIG. 1, there is shown diagrammatically an interactive sports training device 100 such as, but not limited to, the interactive sports training device described in U.S. published application no. 2007-0191141A1, the entire of which is incorporated herein by reference. The interactive sports training device 100 can include a playing surface 110, a projectile such as, but not limited to, a ball 120, and a processor 140 programmed to operate the interactive sports training device. The interactive sports training device 100 is shown with a plurality of sensor modules 10 of the present invention arranged across the playing surface 110 for interaction with the ball 120 in accordance with the operation of the interactive sports training device. The interactive sports training device 100 shown herein could be used in training a hockey player by requiring the hockey player to maneuver and position the ball 120 on the playing surface 110 to simulate maneuvering a hockey puck on ice.

Figure 2:
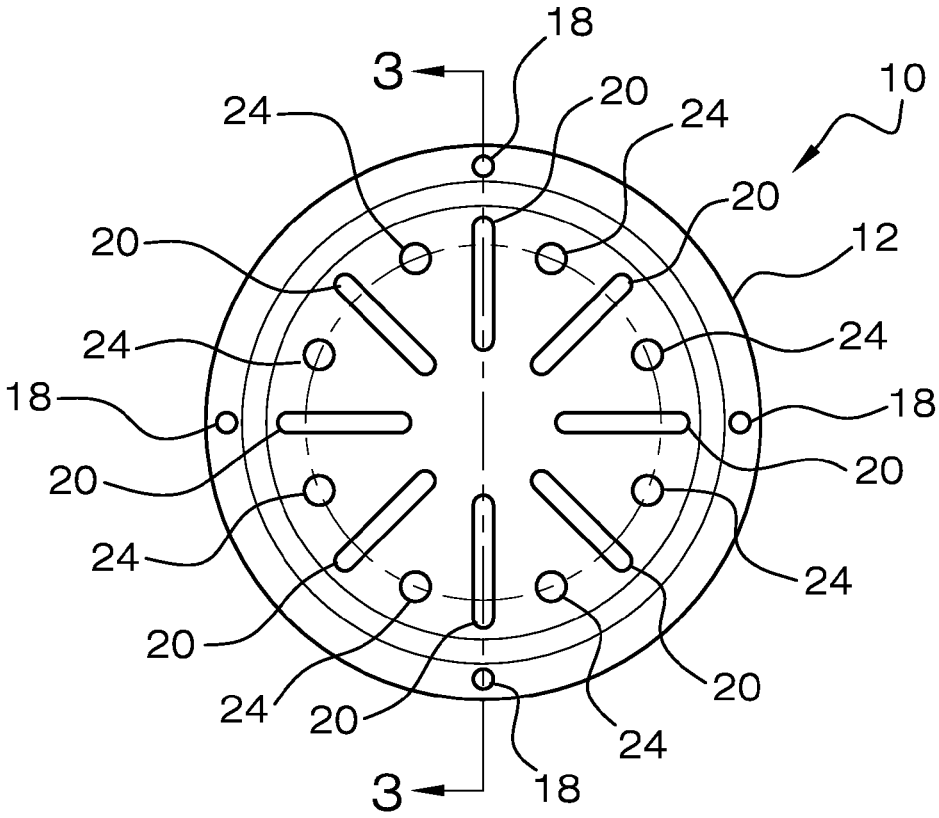
FIG. 2 is a top plan view of a housing of the sensor module of the present invention.
Figure 3:
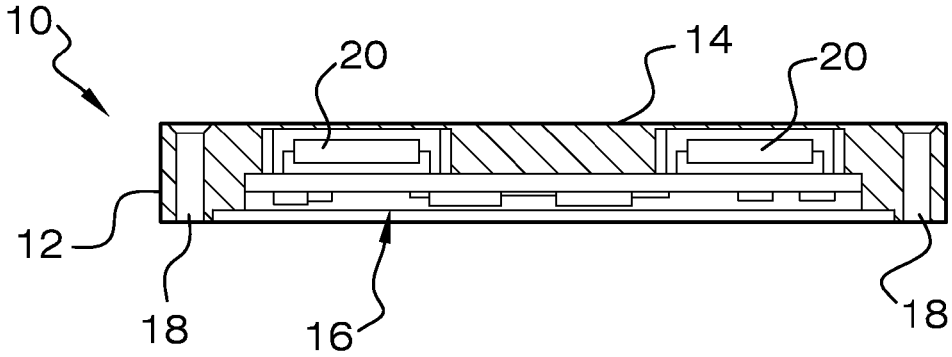
FIG. 3 is a cross-sectional view taken along line 3-3 in FIG. 2 of the sensor module housing.

Referring now to FIGS. 2 and 3, the sensor module 10 in accordance with the principals of the present invention provides, in a single integral unit, a selectively illuminated target and a sensor means for detecting a moving projectile brought in close proximity to the illuminated target. The particular construction of the sensor module 10 provides increased accuracy in the detection of a moving projectile over existing sensor configurations. As such, the sensor module 10 is well suited for use in interactive sports training devices including moving projectiles, such as ball 120, which must be brought in close proximity of a target.

The sensor module 10 includes a housing 12 having positioned therein a plurality of sensors 20 and one or more light sources 24 arranged in such a configuration that provides increased accuracy in the detection of a moving projectile. The housing 12 of the sensor module 10 has an upper surface 14, and an interior space 16. The housing 12 can be made partially or completely of plastic. The housing 12 can be made partially or completely of a transparent plastic. Preferably, the housing 12 is made of a non-ferrous material. In one embodiment, the housing 12 is generally shaped as shallow cylinder having a greater diameter than its height. In one embodiment, the housing 12 has a diameter of about 3.5 inches and a height of about 0.5 inches. A plurality of vertical holes 18 are equally spaced around the perimeter of the housing 12 for receiving fasteners (not shown) to attach the housing to a surface, such as a playing surface of an interactive sports training device. Preferably, the housing 12 is adapted to be received by a playing surface, such as for example, within a recess formed through the playing surface such that the upper surface 14 is flush with the playing surface.

Figure 4:
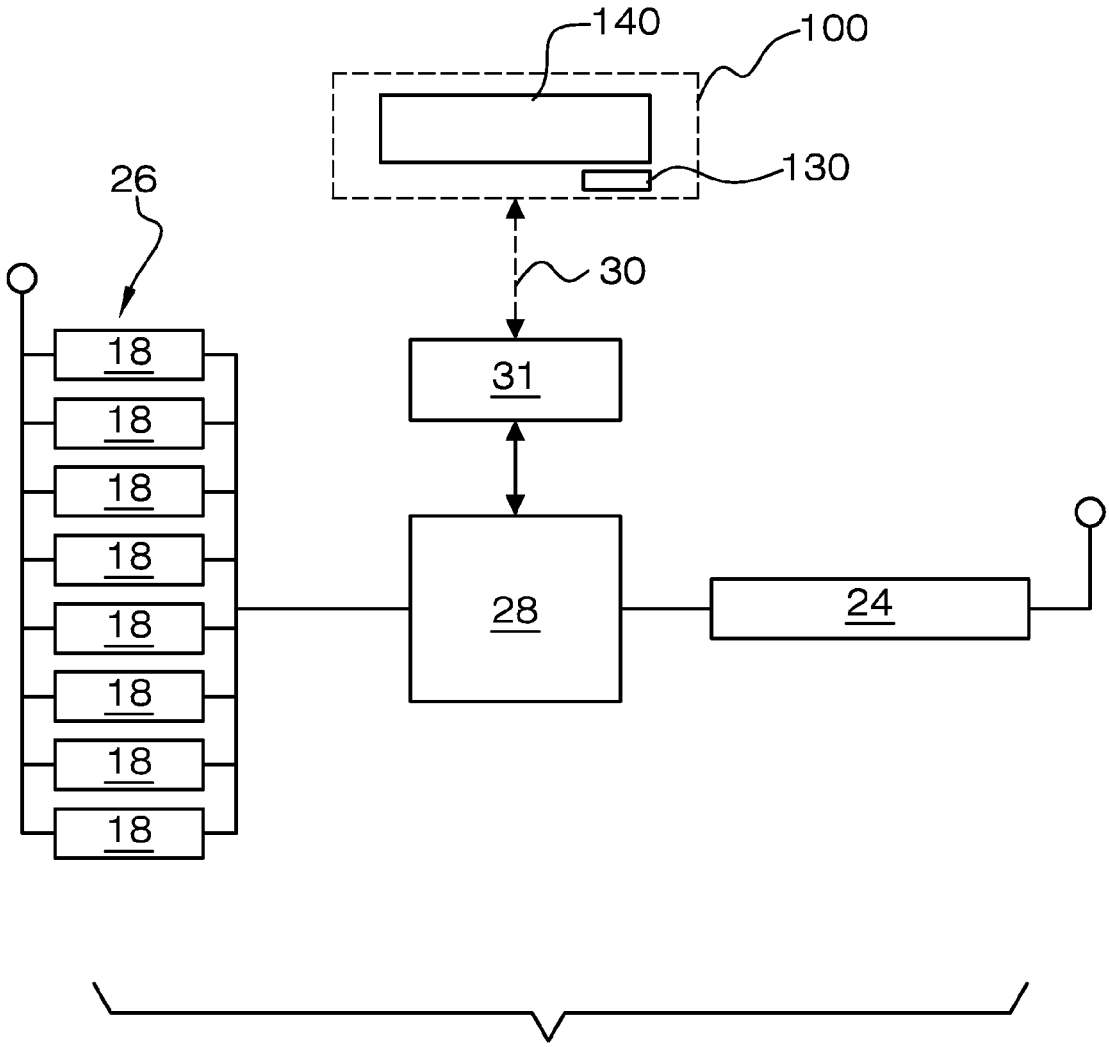
FIG. 4 is a simplified electrical schematic of an electric circuit of the sensor module.

A plurality of sensors 20 are arranged within the housing 12 and are configured to detect a projectile in close proximity of one or more light of the sources 24, such as light emitting diodes. The phrase "close proximity" is defined herein as when two objects are separated by a space equal to or less than about one inch. Each sensor 20 is electrically connected together in parallel forming a sensor unit 26, as best shown in FIG. 4, which is a simplified schematic of sensor module 10. The sensor unit 26 is associated with each of the one or more light sources 24 and is triggered when a projectile of an interactive training device, such as ball 120, is brought into close proximity to one or more of the light sources 24. Each light source 24 is arranged within the housing 12 to be visible through the upper surface 14 when activated.

Figure 5:
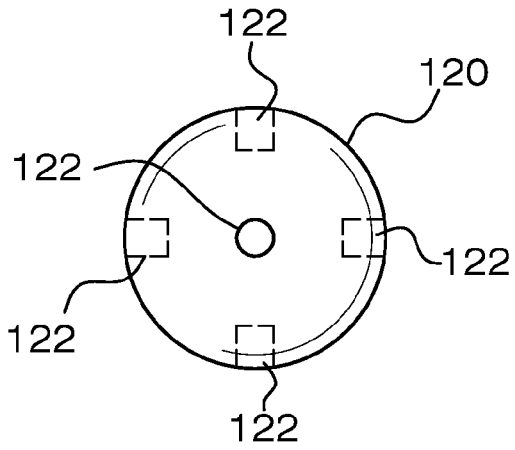
FIG. 5 is a diagrammatic view of a projectile used in an interactive sports training device.

To increase accuracy, the sensors 20 are arranged in the housing 12 in a polar array about the center 22 of the housing 12 with spaces between adjacent sensors. The one or more light sources 24 are arranged within the housing 12 with at least one light source located in each space between adjacent sensors 20. In this manner, the sensors 20 and the light sources 24 are each equally spaced radially around the housing 12 increasing the overall detection area of the sensors within the sensor module 10. Each sensor 20 can be a magnetic field sensor including, but not limited to, a magnetic reed switch. The projectile, such as ball 120, can include one or more emitter 122 for detection by sensors 20, as best seen in FIG. 5. In one embodiment, each emitter 122 can be a magnetic field emitter including, but not limited to, a rare earth magnet. In one embodiment, the ball 120 includes 6 emitters 122, with one located on each side of the ball. Only 5 emitters 122 are visible in FIG. 5, the remaining emitter is located on the opposite side of ball 120.

In one embodiment, the one or more light sources 24 include a first set of light sources of one color, for example blue, and a second set of light sources of a second color, for example red. The different colored light sources can be activated in accordance with different game modes, and the number of users. For example, the blue light sources could be assigned to a first user, and the red light sources could be assigned to a second user. Accordingly, two players using an interactive sports training device incorporating sensor modules 10 of the present invention could be instructed to bring a projectile in close proximity of a same sensor module depending upon which light source is active.

With further reference to FIG. 4, a microprocessor 28 is powered through a voltage regulator 33 that is connected to a system power supply 130 through bus connector 35 and bus 30. Further, microprocessor 28 is coupled to each of the plurality of light sources 24 and the sensor unit 26. The microprocessor 28 is connectable through RS485 transceiver 31 and a bus 30 to a processor 140 of an interactive training device 100 for bidirectional communication therewith. Generally, the microprocessor 28 is programmed to activate at least one of said plurality of light sources 24 upon receiving a light on command signal from the processor 140, to deactivate said at least one activated light source 24 when the sensor unit 26 is triggered, and to transmit a light status signal to the processor of the interactive training device.

Figure 6:
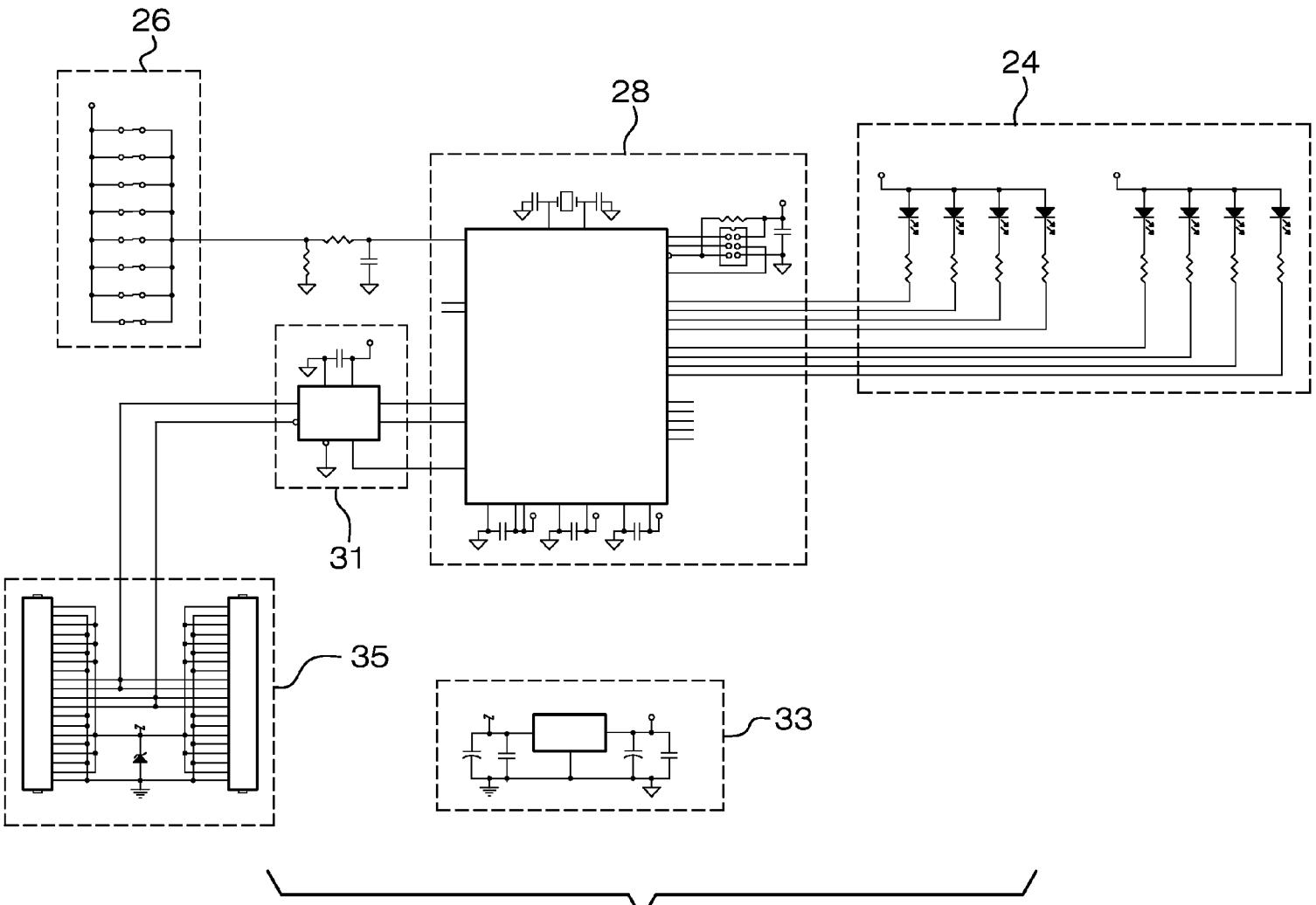
FIG. 6 is a schematic of an electric circuit of the sensor module.

Referring now to FIG. 6, there is shown schematically an electronic circuit 32 according to an embodiment of the sensor module 10. A microprocessor 28 is powered through voltage regulator 33 that is connected to a system power supply 130 through the bus connector 35 and bus 30. Communication between the microprocessor 28 and the processor 100 is accomplished through the RS485 transceiver 31, bus connector 35 and the bus 30. The microprocessor 28 is coupled to each of the plurality of lights sources 24 and the sensor unit 26.

Referring back to FIG. 3, the sensors 20, the light sources 24, the microprocessor 28, and the various other components of the electronic circuit 32 described above are mounted to a printed circuit board 34. The printed circuit board 34 is receivable into the interior space 16 of the housing 12 with the sensors 20 and light sources 24 upwardly facing.

Figure 7:
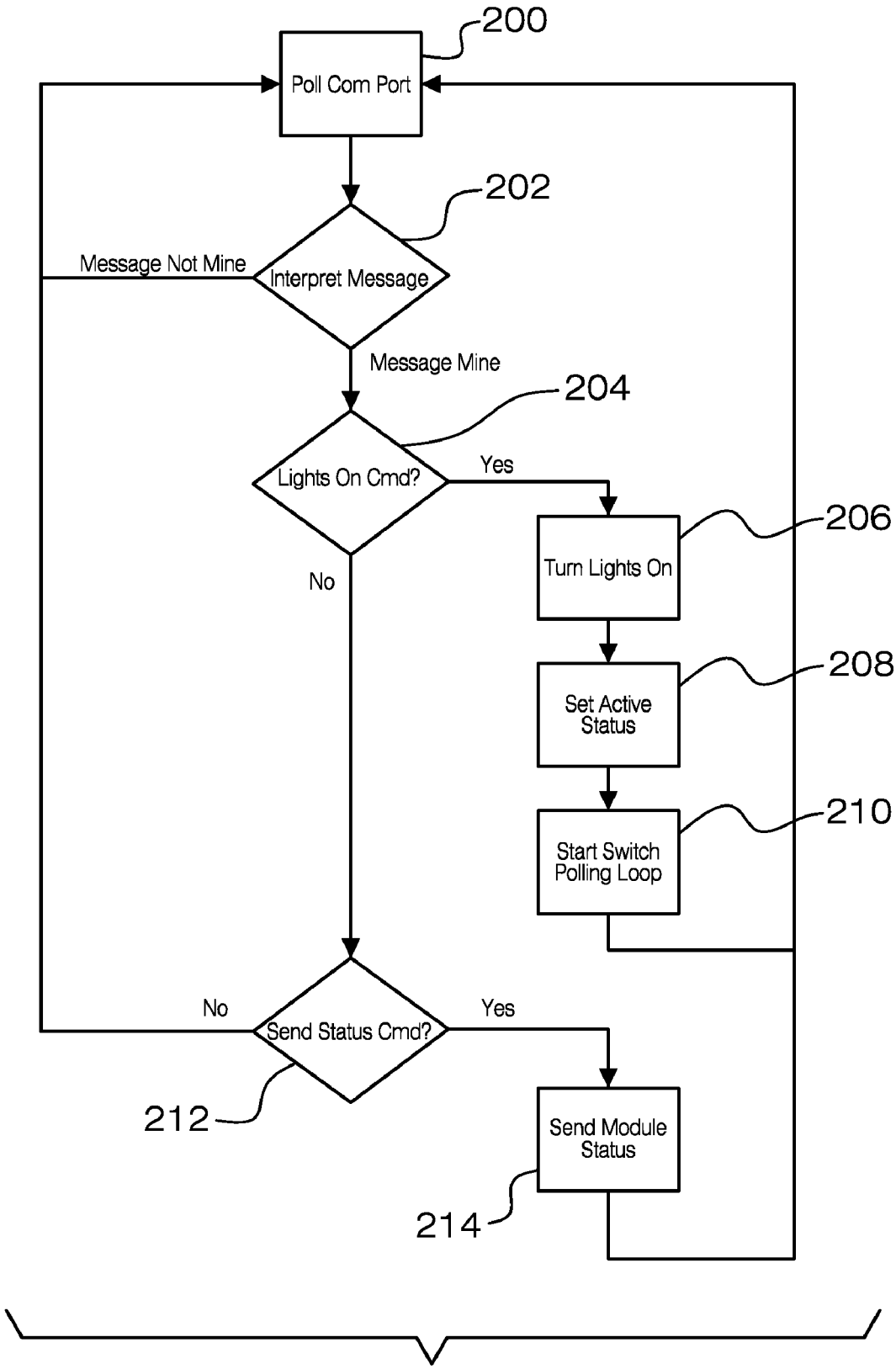
FIGS. 7 and 8 together form a flow diagram of how the circuit shown in FIG. 6 controls the operation of the sensor module.

With reference to FIG. 7, there is shown a high level flow diagram of the program algorithm programmed into microprocessor 28. At block 200, the microprocessor 28 waits to receive a command signal from the processor 140. At block 202, the microprocessor 28 determines if the command signal received from the processor is intended for the sensor module 10 of which microprocessor 28 is associated. If the command signal is intended for the sensor module the process proceeds to block 204, otherwise the process loops back to block 200. At block 204, it is determined if the command signal is a light on command signal. If the command signal is a light on command signal the process proceeds to block 206 otherwise the process proceeds to block 212. At block 206 one or more light sources 24 are activated, at block 208, module status is set to active, and at block 210 sensor polling loop is initiated. If at block 204, it is determined the command signal is not a light on command signal, at block 212 it is determined if the command signal is a status request signal. If the command signal is a status command signal the process proceeds to block 214, otherwise the process loops back to block 200. At block 214 a light status signal is transmitted to processor 140 indicating the status of any one of the light sources 24 as being activated or inactivated, and then the process loops back to block 200.

Figure 8:
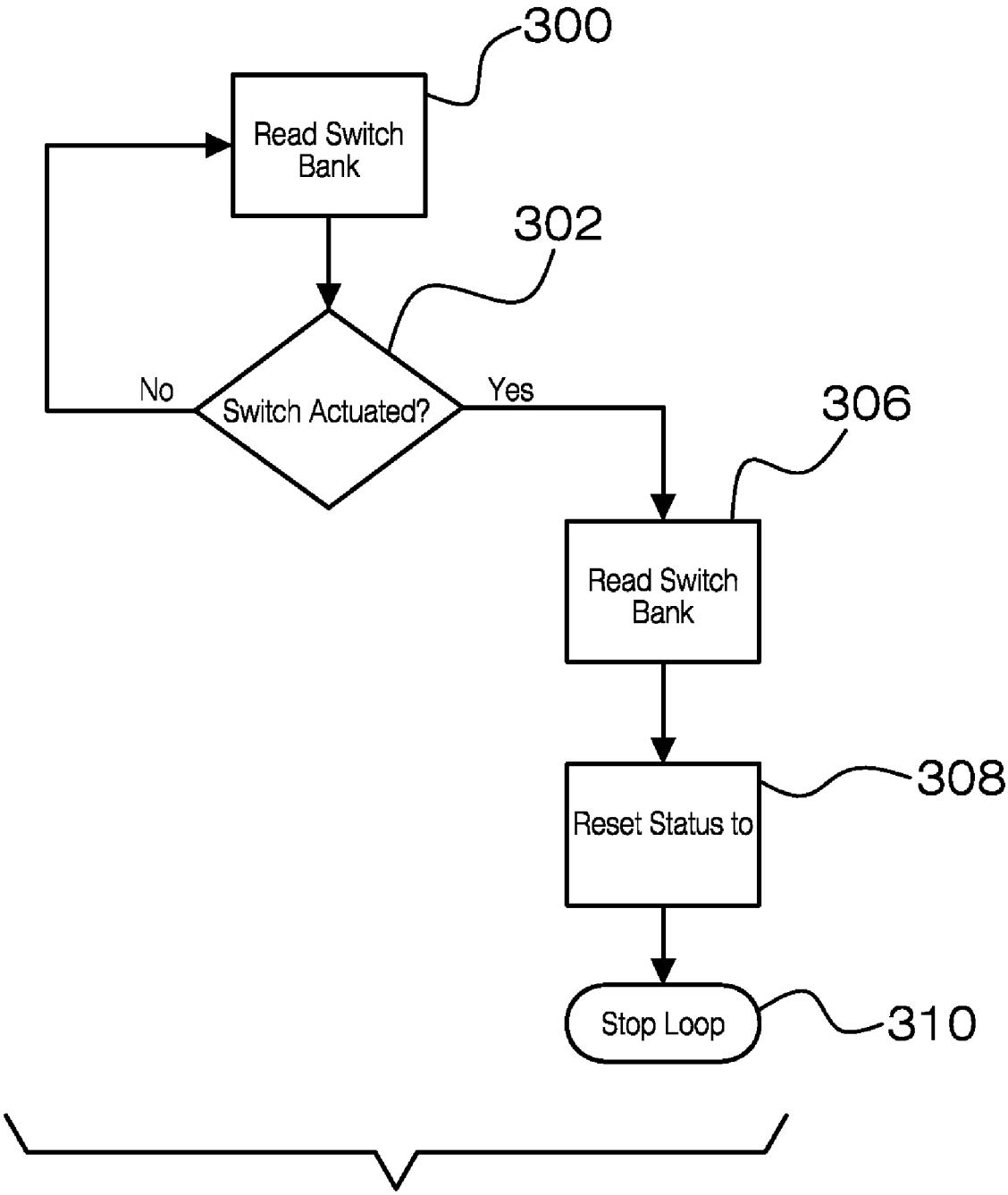

With reference to FIG. 8, a high level flow diagram of the sensor polling loop algorithm is shown. At block 300 the sensor unit 26 is polled. At block 302, it is determined if any sensors 18 of the sensor unit 26 has been triggered. If it is determined a sensor 18 has been triggered, the process proceeds sequential to blocks 306, 308 and 310, otherwise it loops back to block 300. At block 306, all active light sources 24 are turned off. At block 308, the sensor module status is set to inactive, and at block 310 the sensor polling loop is terminated.

Figure 9:
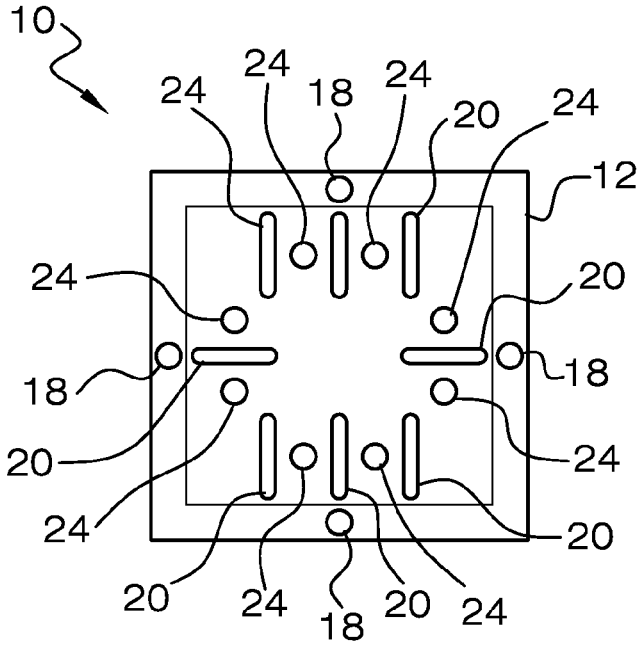
FIG. 9 is a top plan view of an alternative sensor module.
Figure 10:
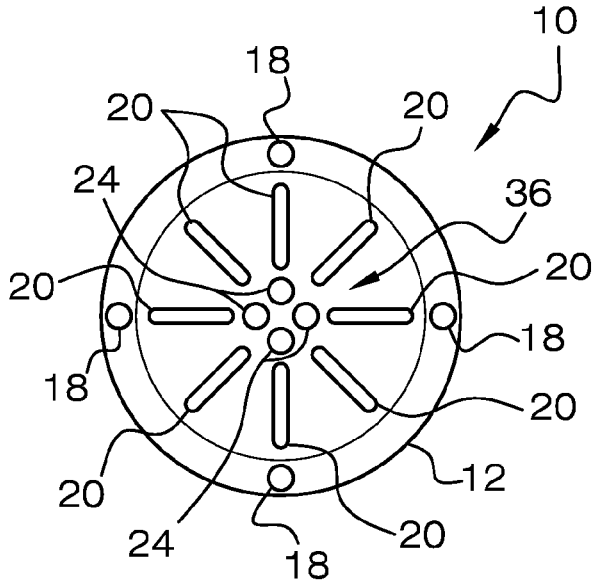
FIG. 10 is top plan view of an alternative sensor module.

Other embodiments are possible, for example, the housing 12 may be provided in various different geometrical shapes including, but not limited to, square, oval, rectangular and octagon. In FIG. 9, the housing 12, when viewed from above, is square or rectangular shaped with the sensors 20 arranged in a rectangular array with a space between adjacent sensors. The light sources 24 are arranged within the housing 12 with at least one light source located in each space between adjacent sensors 20. In FIG. 10, the housing 12, when viewed from above, is circular with the sensors 20 arranged in a closed array defining an interior area 36 bound by the sensors and with the plurality of light sources 24 located within the interior area.

A number of embodiments of the present invention have been described. Nevertheless, it will be understood that various modifications may be made without departing from the spirit and scope of the invention. Accordingly, other embodiments are within the scope of the following claims.

What is claimed is:

1. A sensor module for use in connection with an interactive training device including a processor and a projectile, the sensor module comprising:

a housing with a surface;

a plurality of sensors arranged within said housing, each of said plurality of sensors being electrically connected together forming a sensor unit, a plurality of light sources arranged within said housing, each light source of said plurality of light sources being visible at said surface when activated, wherein said sensor unit is associated with said plurality of light sources and is triggered when a projectile of an interactive training device is brought into close proximity with an activated light source of said plurality of light sources;

a microprocessor coupled to each of said plurality of light sources and said sensor unit, said microprocessor being connectable to a processor of an interactive training device for bidirectional communication therewith; and wherein said microprocessor is programmed to activate at least one of said plurality of light sources upon receiving a light on command signal from the processor, to deactivate said at least one activated light source when said sensor unit is triggered, and to transmit a light status signal to the processor of the interactive training device.

2. The sensor module of claim 1, wherein said plurality of sensors are arranged within said housing in a polar array about a center point with a space between adjacent sensors, and wherein said plurality of light sources are arranged within said housing with at least one light source located in each space between adjacent sensors.

3. The sensor module of claim 1, wherein said plurality of sensors are arranged within said housing in an rectangular array with a space between adjacent sensors, and wherein said plurality of light sources are arranged within said housing with at least one light source located in each space between adjacent sensors.

4. The sensor module of claim 1, wherein said housing is adapted to be received by a playing surface of the interactive training device.

5. The sensor module of claim 1, wherein said surface of said housing is a playing surface in an interactive training device.

6. The sensor module of claim 1, wherein each of said sensors is a magnetic field sensor.

7. The sensor module of claim 5, wherein said magnetic field sensor is a magnetic reed switch.

8. The sensor module of claim 1, wherein each of said plurality of sensors are electrically connected together in parallel forming said sensor unit.

9. The sensor module of claim 1, wherein said plurality of sensors are arranged within said housing in a closed array defining an interior space bound by said plurality of sensors, and wherein said plurality of light sources are located within said interior space.

* * * * *